United States Patent [19]

Kreinheder et al.

[11] 4,439,747

[45] Mar. 27, 1984

[54] METHOD FOR IMPROVING SELECTIVITY IN CYLINDRICAL $TE_{011}$ FILTERS BY $TE_{211}/TE_{311}$ MODE CONTROL

[75] Inventors: Donald E. Kreinheder, Granada Hills; Terrance D. Lingren, Canoga Park, both of Calif.

[73] Assignee: Hughes Aircraft Co., El Segundo, Calif.

[21] Appl. No.: 385,947

[22] Filed: Jun. 7, 1982

[51] Int. Cl.[3] ..... H01P 1/207; H01P 1/208; H01P 1/16

[52] U.S. Cl. ..... 333/208; 333/21 R; 333/212; 333/228

[58] Field of Search ..... 333/227-235, 333/202-212, 21 R, 21 A, 24 R, 245, 248, 251

[56] References Cited

U.S. PATENT DOCUMENTS 2,694,186 11/1954 Kinzer et al. ..... 333/212
2,720,630 10/1955 Kannenberg et al. ..... 333/228

OTHER PUBLICATIONS

Thal, Jr.—"Cylindrical $TE_{011}/TM_{111}$ Mode Control by Cavity Shaping", IEEE Trans. on Microwave Theory and Techniques, vol. MTT-27, No. 12, Dec. 1979, pp. 982-986.

Thal, Jr.—"Cylindrical $TE_{011}/TM_{111}$ Mode Control by Cavity Shaping", Conference: IEEE MTT-5 International Microwave Symposium Digest, Orlando, FL, USA, (30 Apr.-2 May 1979), pp. 272-274.

*Primary Examiner*—Marvin L. Nussbaum
*Attorney, Agent, or Firm*—Charles D. Brown; A. W. Karambelas

[57] ABSTRACT

A method for designing low loss cylindrical $TE_{011}$ mode resonators which permits selective placement of a transmission null at a frequency near the $TE_{011}$ resonance frequency. The frequencies of the $TE_{211}$ and $TE_{311}$ modes, that are naturally excited in the resonator, are controlled by the angular displacement of the resonator input port and output port and by the relative amplitude of the $TE_{011}$ mode compared to the $TE_{211}$ and $TE_{311}$ modes. Proper placement of the transmission nulls improves the selectivity of the $TE_{011}$ resonator, and/or can be used to filter out unwanted noise at the frequency of the transmission null. A lumped constant analog circuit model is presented to assist in design of the resonator.

6 Claims, 16 Drawing Figures

+90
-90
θ = 130°
89
90
91
90
INSERTION LOSS (dB)
0
40
80
30
33
36
39
FREQ. (GHz.)

+90
-90
θ = 140°
89
90
91
90
INSERTION LOSS (dB)
0
40
80
30
33
36
39
FREQ. (GHz.)

+90
-90
θ = 150°
89
90
91
INSERTION LOSS (dB)
0
40
80
30
33
36
39
FREQ. (GHz.)

METHOD FOR IMPROVING SELECTIVITY IN CYLINDRICAL $TE_{011}$ FILTERS BY $TE_{211}/TE_{311}$ MODE CONTROL

BACKGROUND OF THE INVENTION

1. Field of the Invention

This invention relates to the design of microwave cylindrical $TE_{011}$ filters and specifically to the design of such filters utilizing $TE_{211}/TE_{311}$ mode control for the purpose of improving filter selectivity and/or placing a transmission null at a desired frequency.

2. Description of the Prior Art

Previous efforts have been made to control the response characteristics of microwave $TE_{011}$ resonators. Cavity shaping as a means to control the resonator response was reported by Herbert L. Thal, Jr. in *IEEE Transactions Microwave Theory and Techniques.* Vol. MTT-27, No. 12, Dec. 1979 at pages 982 to 986, a copy of which accompanies this application for a patent. That same article provides good background information for the subject of this application and it is hereby incorporated herein in full by this reference. Thal observed that in spherical cavities and in cylindrical cavities the $TE_{011}$ mode was accompanied by degenerate modes at the same frequency. Thal suggested that there should exist intermediate cavity shapes, i.e., intermediate a cylinder and a sphere, which would isolate the desired cylindrical $TE_{011}$ mode from the degeneracies that exist in the cylindrical and spherical cases.

While Thal's paper is primarily concerned with investigating the shape of the cavity, he does discuss, though only briefly, the suppression of the $TE_{211}/TE_{311}$ mode effects by careful selection of the angular displacement between the input port and the output port. He concludes that a displacement of 144 degrees ($\theta=36$ degrees in FIG. 9 of Thal) is the approximate optimum angle to simultaneously suppress not only the $TE_{211}$ and $TE_{311}$ coupling, but the residual nonresonant $TE_{211}/TE_{311}$ pattern as well.

SUMMARY OF THE INVENTION

A method is presented for custom tailoring the frequency transmission characteristics of a microwave resonator in two important aspects. By adjusting the angular displacement between the input port of the resonator and the output port, it is possible to (1) increase the selectivity of the resonator to the $TE_{011}$ mode and/or (2) place a frequency transmission null of the resonator at a preselected frequency to thereby filter out unwanted signals occurring at that frequency. An analog circuit model is presented to assist in design of the resonator to achieve the desired result, i.e., increase in selectivity or placement of a transmission null.

DETAILED DESCRIPTION OF THE INVENTION

Figure 1A:
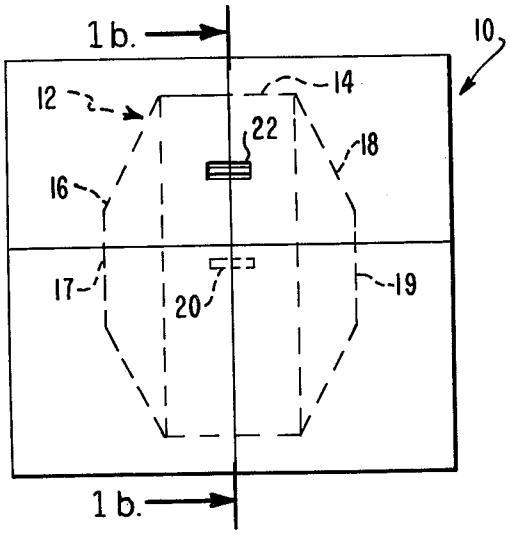
FIG. 1*a* is an exterior view of a cylindrical $TE_{011}$ mode resonator.

The high unloaded Q of the cylindrical $TE_{011}$ mode is attractive for low loss filters, especially at the higher microwave frequencies where transmitter power and receiver sensitivity are often limited and expensive. However, the design of cylindrical $TE_{011}$ mode filters is complicated by the large number of modes that resonate at frequencies close to or degenerate with the $TE_{011}$ mode. The response of these modes must be controlled to obtain usable filter characteristics. The $TM_{111}$ mode is of particular concern because it is degenerate with the $TE_{011}$ mode in the right cylindrical resonator. The $TE_{112}$, $TE_{211}$, $TE_{311}$, $TM_{011}$, $TM_{012}$, $TM_{110}$ and $TM_{210}$ modes can also seriously affect the filter performance depending on the particular application and the filter design. The presence of these modes also makes it difficult to compute the filter response by conventional techniques. $TE_{011}$ filter design is thus primarily an experimental problem.

The relative frequencies of the resonances of the $TE_{011}$ mode and the other modes, with the exception of the degenerate $TM_{111}$, can be controlled, within limits, by the choice of the diameter to length ratio of the cavity. However, large changes in the diameter to length ratio can result in significant reduction in the unloaded Q. Atia and Williams (see "General $TE_{011}$ mode waveguide bandpass filters", *IEEE Transactions Microwave Theory and Techniques,* Vol. MTT-24, pp. 640–648, October 1976) have shown that the $TM_{111}$ resonant frequency can be separated from the $TE_{011}$ resonance by thin metal posts or by dielectric material on the cavity end walls. Thal (see "Cylindrical $TE_{011}/TM_{111}$ Mode Control by Cavity Shaping", *IEEE Transactions Microwave Theory and Techniques,* Vol. MTT-27, pp. 982–986, December 1979) has shown that a similar effect can be obtained from shaping the cavity by chamfering the edges of the cavity. The degree of shaping can also be used to control the relative frequencies of the modes without degrading the unloaded Q of the $TE_{011}$ mode. Cavity shaping is particularly attractive because it permits all the resonators of a filter to have different shapes, so that when they are synchronously tuned to the $TE_{011}$ mode they are not synchronously tuned for the other modes.

Even with cavity shaping, suppression and control of the unwanted modes is still necessary. TM modes can be suppressed by using narrow rectangular apertures that are oriented to favor coupling to the TE modes. The coupling through the apertures is approximately proportional to the cube of its length in the direction of the magnetic field, so the reduction in the TM mode response can be large. The $TE_{112}$ mode can be suppressed by using sidewall coupling at the center of the resonator since the mode possesses odd symmetry about the center. The most difficult modes to control are the $TE_{211}$ and $TE_{311}$ modes. Atia and Williams (same reference) achieved excellent results in suppressing these modes, apparently aided in part by using a combination of end wall and sidewall coupling. However, the use of end wall coupling is not always possible because of the physical configuration or other constraints. Thal (same reference) and others have attempted to suppress the $TE_{211}$ and $TE_{311}$ modes in sidewall-coupled cavities by using an angular displacement between the coupling apertures rather than having the apertures directly opposite one another in the resonator. This permits one aperture to be at a location of low field strength for the unwanted modes excited by the other aperture. This has been of limited success as it usually results in asymmetrical rejection characteristics due to $TE_{211}/TE_{311}$ mode contamination.

Even if $TE_{211}$ and $TE_{311}$ modes cannot be suppressed in sidewall-coupled cavities, the modes can be controlled by the method disclosed herein so as to enhance the filter performance for many applications.

A representative cylindrical resonator 10 is shown in FIG. 1*a*. Within the interior of the resonator 10 is a cylindrical cavity 12 shaped according to the teachings of Thal supra. The cavity 12 has a centrally located cylindrical section 14. Each end of the cylindrical section 14 has its edges chamfered so as to form the two conical sections 16 and 18 having flat disc shaped end walls 17 and 19 respectively. The cavity 12 has an input port 20 and an output port 22 angularly displaced about the central cylindrical section 14 by the angle $\theta$ (see FIG. 1*b*).

Figure 2:
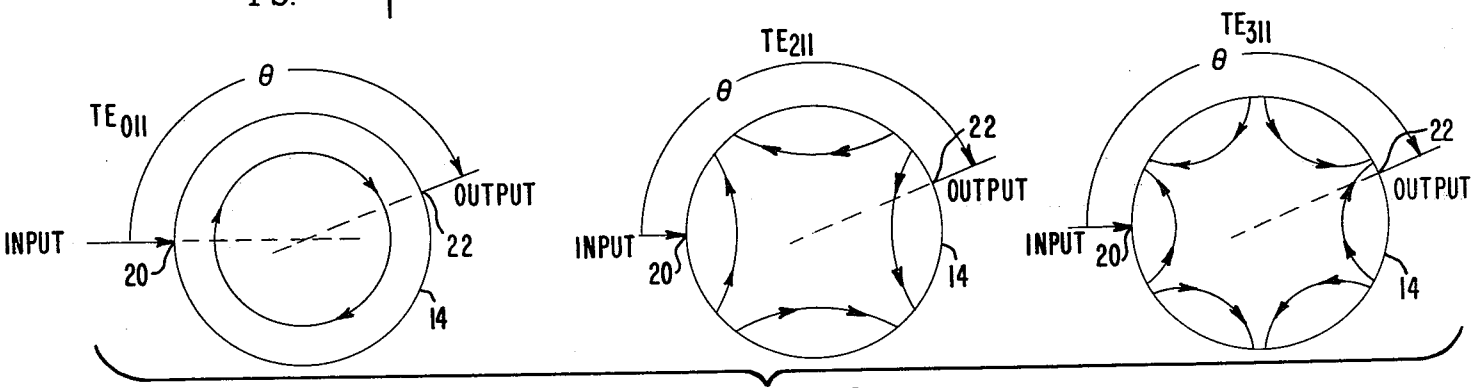
FIG. 2 illustrates the electric field configurations for the $TE_{011}$, $TE_{211}$ and $TE_{311}$ modes in a cylindrical resonator.

The coupling to a cylindrical resonator such as 10 is solely magnetic for the $TE_{011}$ mode and is predominantly magnetic for the $TE_{211}$ and $TE_{311}$ modes. However, it is easier to visualize the fields at the center of the cavity 12 in terms of the electric fields rather than the magnetic fields. FIG. 2 shows the electric fields oriented for excitation by an input port 20 with magnetic coupling. As can be seen, there is no change in the $TE_{011}$ electric fields with variation of the angle $\theta$. Therefore, coupling through the resonator 10 by means of the $TE_{011}$ mode should not be a function of the angular displacement ($\theta$) between the input port 20 and the output port 22 coupling apertures. However, the coupling through the $TE_{211}$ and $TE_{311}$ modes does vary with the angular displacement ($\theta$) of the coupling apertures. For the $TE_{211}$ mode minimum magnetic coupling occurs at angular displacements $\theta$ of 45 degrees and 135 degrees. For the $TE_{311}$ mode minimum magnetic coupling occurs at $\theta$ equal to 30 degrees, 90 degrees and 150 degrees. There is no value of $\theta$ that will simultaneously minimize coupling both modes. However, an angular displacement in the range of 135 degrees to 150 degrees could provide a reasonable compromise for achieving reduced coupling to both modes.

The angular displacement $\theta$ between the input port 20 and the output port 22 affects not only the magnitude of the coupling but also the relative phase. The response for the $TE_{211}$ mode is a function of $\theta$. There are four regions of varying amplitude and four changes in phase. As the angle $\theta$ is changed, the amplitude will vary in a continuous manner, but there will be an abrupt 180 degree phase change in going from one region to another. The response of the $TE_{311}$ mode is similar to that of the $TE_{211}$ mode except there are six regions of varying amplitude and six changes of phase. For the angle $\theta$ shown in FIG. 2, the electric fields for the $TE_{011}$ and the $TE_{211}$ modes are in phase at the output port 22, but the $TE_{011}$ and $TE_{311}$ modes are out of phase. For other values of $\theta$, the phase relationships can be reversed, or the $TE_{011}$ mode may be simultaneously in phase, or out of phase, with both the $TE_{211}$ and $TE_{311}$ modes.

Figure 3:
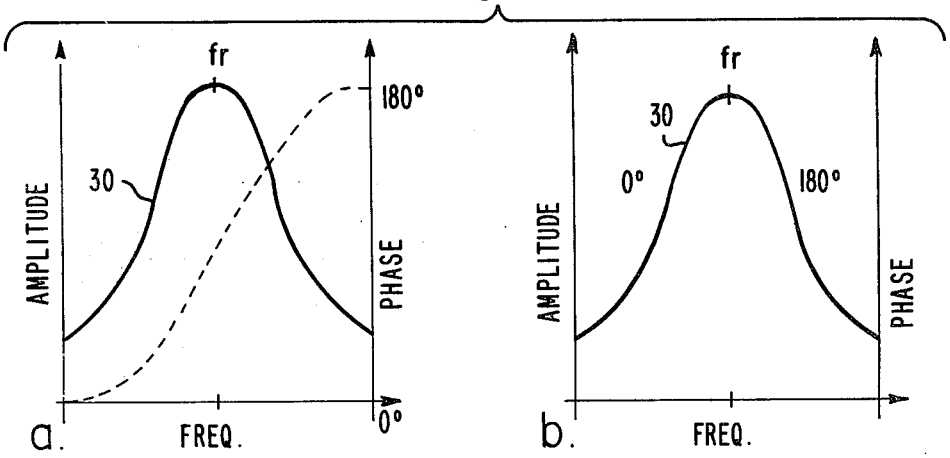
FIG. 3*a* is a graph of the phase and amplitude response of a resonator plotted as a function of frequency.
FIG. 3*b* is a shorthand representation of the graph of FIG. 3*a*.

A typical phase and amplitude response for a single resonator and fixed value for $\theta$ is shown in FIG. 3*a*. The amplitude peaks at the resonant frequency of the cavity for the particular mode being illustrated. The phase changes from $\theta$ degrees to 180 degrees as the frequency is increased. A shorthand graphical method for illustrating the amplitude and phase change on a single graph is given in FIG. 3*b*. Thus, the resonant frequency $f_r$ occurs at the peak of curve 30 and the phase changes from near zero to near 180 degrees as the frequency passes through the resonant frequency.

Figure 4:
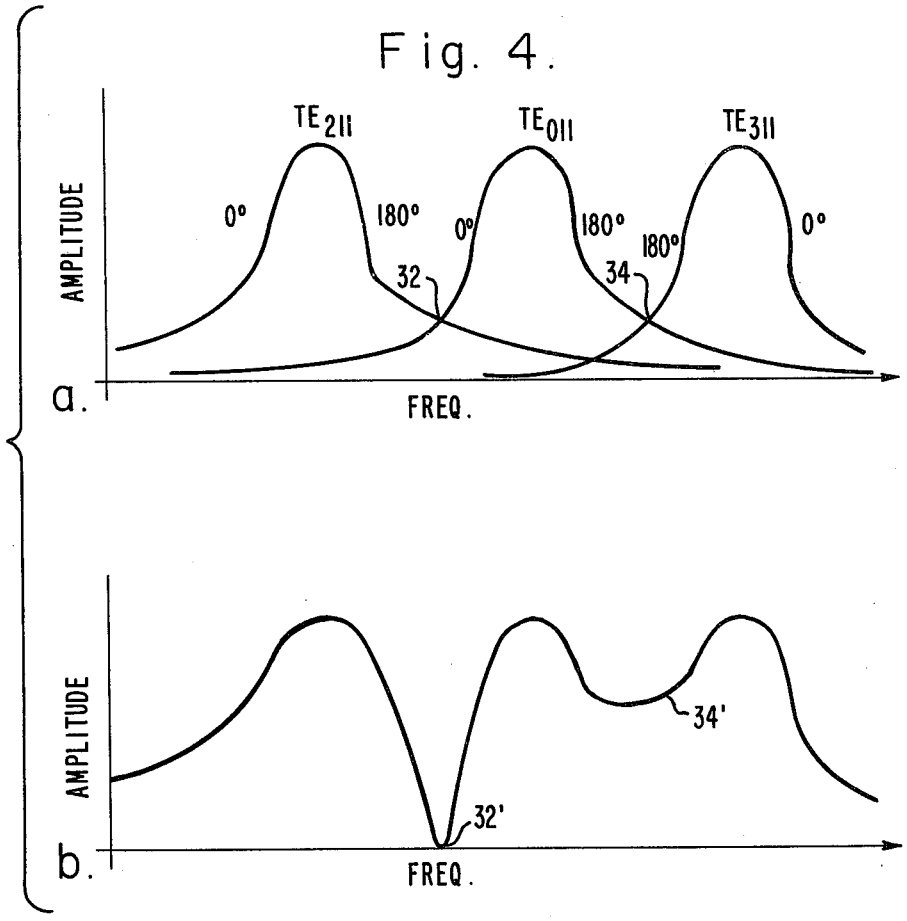
FIG. 4*a* is a graph of the superimposed phase and amplitude response of a resonator for the $TE_{211}$, $TE_{011}$ and $TE_{311}$ modes for the input/output configuration shown in FIG. 2.
FIG. 4*b* is a graph of the sum of the responses of FIG. 4*a*.

A superimposed graph of each of the $TE_{011}$, $TE_{211}$ and $TE_{311}$ modes, showing amplitude and phase variation for a single resonator, is given in FIG. 4*a*. The $TE_{011}$ curve is shown in the center of the frequency range with a phase of zero degrees on its left hand side and 180 degrees on its right hand side. This phase relationship (i.e., the polarity of the electric field) may be used as a reference with respect to the electric fields of the $TE_{211}$ and $TE_{311}$ modes. In moving through the angle $\theta$ in the vicinity of the output port for the $TE_{211}$ mode, we move with the arrowhead of the electric field (see FIG. 2) hence the electric field is of the same polarity as that of the $TE_{011}$ mode. Thus, the $TE_{211}$ curve in FIG. 4*a* is also plotted with the phase of zero degrees on its left hand side and 180 degrees on its right hand side. For frequencies between the $TE_{211}$ and $TE_{011}$ resonances, e.g., at point 32, the magnitude of the contribution from each mode ($TE_{211}$ and $TE_{011}$) is the same but they are relatively out of phase. The component of the $TE_{211}$ mode is near 180 degrees phase while the component of the $TE_{011}$ mode is near zero degrees phase. The two components thus tend to cancel one another and produce the transmission null 32' shown in FIG. 4*b*. If we move in the direction of the angle $\theta$ in the vicinity of the output port for the $TE_{311}$ mode (see FIG. 2), we move against the arrowhead of the electric field indicating that the electric field of the $TE_{311}$ mode is of the opposite polarity as that of the $TE_{011}$ mode. Thus, the $TE_{311}$ curve in FIG. 4*a* is plotted with a phase of 180 degrees on its left hand end and zero degrees on its right hand end. This is the opposite of the orientation for the $TE_{011}$ mode. As can be seen in FIG. 4*a*, for frequencies between the $TE_{311}$ and $TE_{011}$ resonances, e.g., at point 34, the magnitude of the contribution from each mode ($TE_{311}$ and $TE_{011}$) is nearly the same and both are of relatively the same phase (i.e., nearly 180 degrees). The two components thus tend to add to one another and instead of producing a transmission null, produce only a relative transmission valley 34' shown in FIG. 4*b*. By similarly summing the individual component contributions of the superimposed mode curves of FIG. 4*a*, a sum curve, representing the overall response of the single resonant cavity can be plotted. This sum is shown in FIG. 4*b*.

In order to determine the change in selectivity of a resonator with a change in the angular displacement $\theta$, three resonators were constructed. One resonator had the angle $\theta$ set to 130 degrees, another was set to 140 degrees and the third resonator had $\theta$ set to 150 degrees. Each of the three resonators had identical cavities which were shaped according to the teachings of Thal (supra) and were provided with a moveable end wall on one end of the cavity to adjust the resonant frequency.

Insertion loss measurements were made on each resonator. The insertion loss measurements were made with a Hewlett Packard R8747A $K_a$ band transmission and reflection test unit. Due to the swept frequency bandwidth limitation of the test unit, the measurement of results had to be made in 2 GHz segments and then pieced together to cover the full frequency range of interest. The test results are plotted in FIGS. 5, 6 and 7 for $\theta$ equal to 130 degrees, 140 degrees and 150 degrees, respectively.

As expected, the amplitude response of the $TE_{011}$ mode, shown in the center of the frequency range, does not vary with changes in $\theta$. The response of the $TE_{211}$ and the $TE_{311}$ modes appear at the lower end and upper end of the frequency range respectively. Both responses show large changes with change in $\theta$.

The response characteristics in the vicinity of the $TE_{011}$ resonance are of primary concern. The $TE_{011}$ resonance is indicated by the peak 50. The slope of the curve immediately below the peak and above the peak gives a graphic indication of the selectivity (or rejection) of the resonator for the $TE_{011}$ mode. The steeper the slope the greater the selectivity. Those areas of the curve on either side of the peak 50 are referred to as skirts 52 and 54 of the resonance. The steepest skirts for the $TE_{011}$ mode appear in FIG. 7 for the low frequency skirt 52 and in FIG. 5 for the high frequency skirt 54. A compromise which achieves reasonable skirt steepness for both high and low frequency skirts is $\theta$ equal to 140 degrees. From FIGS. 5, 6 and 7, it is apparent that steepness of one skirt can be sacrificed for even greater steepness in the other skirt. If, in a particular application, one is primarily concerned with achieving high steepness for the low frequency skirt 52, then $\theta$ equal to 150 degrees is appropriate. However, this will reduce the steepness of the high frequency skirt 54. Depending on the particular application, $\theta$ can be adjusted to achieve the desired degree of steepness (within a limited range) for the high frequency or low frequency skirt.

Once the degree of chamfering of the corners of the resonant cavity has been set according to the teachings of Thal, the steepness of one skirt (52 or 54) can be increased only at a sacrifice in steepness of the other skirt (54 or 52). However, if the degree of chamfer is a parameter that can be adjusted, the chamfer can be chosen (as taught in Thal) so as to vary the coupling strength through the $TE_{211}$ and $TE_{311}$ modes relative to the coupling strength through the $TE_{011}$ mode. By adjusting the degree of chamfer, the relative resonant frequencies of the $TE_{211}$ and $TE_{311}$ modes can be moved closer to, or farther away from, the resonant frequency of the $TE_{011}$ mode. Hence, the intervening nulls 56 and 58 would also be moved closer to, or farther from, the $TE_{011}$ resonance. This adjustment of chamfer would affect the steepness of skirt 52 and skirt 54 simultaneously.

Figure 5:
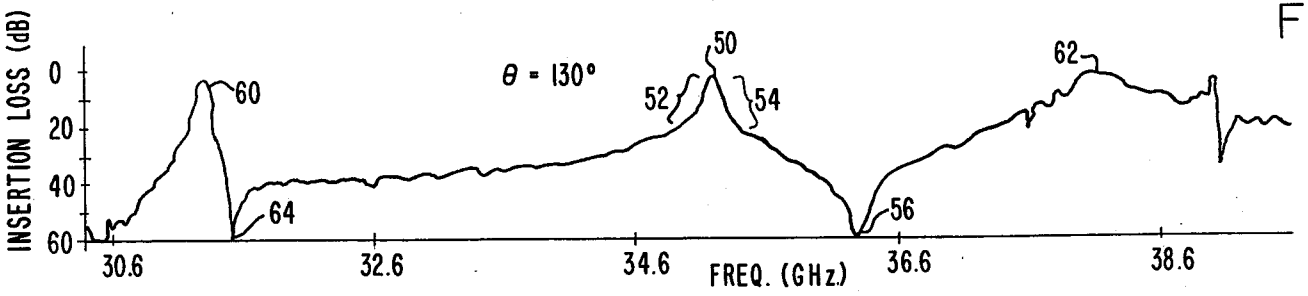
FIG. 5 is a graph of the measured insertion loss of a resonator with an angular displacement of 130 degrees.
Figure 6:
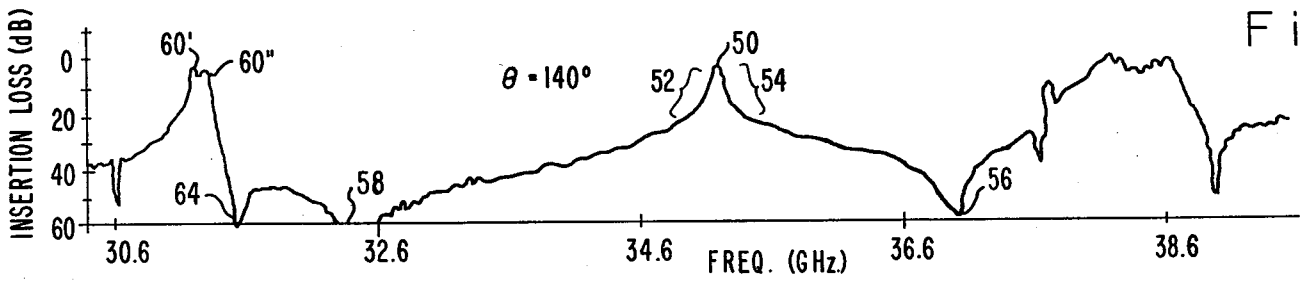
FIG. 6 is a graph of the measured insertion loss of a resonator with an angular displacement of 140 degrees.
Figure 7:
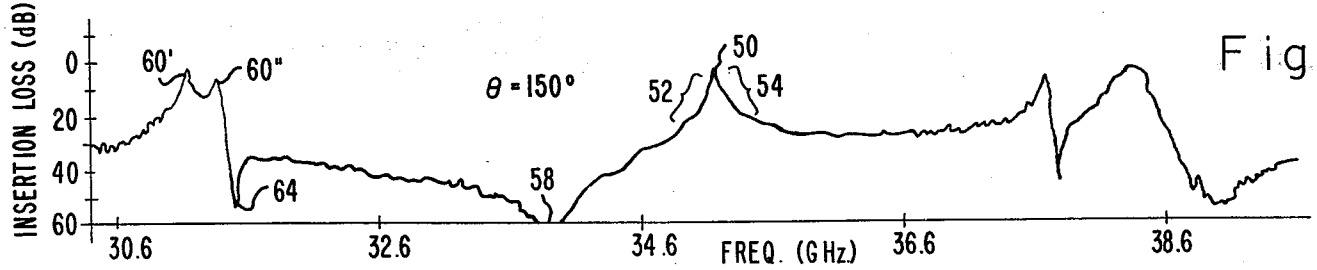
FIG. 7 is a graph of the measured insertion loss of a resonator with an angular displacement of 150 degrees.

Also to be noted are the various transmission nulls. In FIG. 5, with $\theta$ equal to 130 degrees, a transmission null in the frequency range near the $TE_{011}$ resonant frequency occurs at 56 at about 36.3 GHz. In FIG. 6, with $\theta$ equal to 140 degrees, the transmission null 56 has shifted to about 37 GHz. In FIG. 7 with $\theta$ equal to 150 degrees, the transmission null has entirely disappeared. Thus, by varying the angle $\theta$ the location of the transmission null on the high frequency side of the $TE_{011}$ mode can be adjusted. If, in a particular system, it is desired to filter out a noise signal at about 37 GHz, setting $\theta$ equal to 140 degrees would do so. On the low frequency side of the $TE_{011}$ mode resonance (at about 35.2 GHz) in FIG. 5 with $\theta$ equal to 130 degres, there is no close by transmission null. However, in FIG. 6 with $\theta$ equal to 140 degrees a transmission null 58 appears at about 32.4 GHz. By changing $\theta$ to 150 degrees, the transmission null 58 can be shifted to about 33.9 GHz. Hence, if it is desired to filter out a noise signal at about 33.9 GHz, setting $\theta$ equal to 150 degrees would do so.

The frequency at which a transmission null 56 or 58 occurs may thus be adjusted, within limits, by adjusting $\theta$. If the transmission null is moved closer to the $TE_{011}$ resonant frequency, the skirt closest to the transmission null will be made steeper, thereby increasing the selectivity of the resonator on that side of the frequency band. Thus, FIG. 5 shows a fairly steep skirt 54 but a much less steep skirt 52. FIG. 7 shows a fairly steep skirt 52 but a much less steep skirt 54. A compromise, showing moderately steep skirts 52 and 54 is shown in FIG. 6 where both transmission nulls 56 and 58 are present and fairly well separated from the $TE_{011}$ resonant frequency.

While the above are the more pertinent observations to be made upon inspection of FIGS. 5, 6 and 7, other features also deserve attention. The $TE_{211}$ resonance peak 60 occurs at about 31.3 GHz. In FIG. 5 it is fairly well defined as a single peak. In FIG. 6 it has split into two peaks 60' and 60'' and in FIG. 7 the split has become even more pronounced. The center frequency has remained at about 31.3 GHz. The splitting of the peak into two peaks is similar to the response one would expect from two cavities which were operating in an "over-coupled" mode. Similarly, the $TE_{311}$ mode resonance peak 62 at 38.1 GHz in FIG. 5 shows some evidence of splitting in FIG. 6 but not so in FIG. 7. Just below the $TE_{311}$ resonant frequency there is variation in response at about 37.7 GHz believed to be caused by the $TE_{112}$ mode which had not been fully suppressed. The response occurs due to the asymmetries introduced into the cavity by the use of the moveable end wall tuner mentioned earlier. The transmission null 64 occuring just above the $TE_{211}$ resonant frequency and at 31.5 GHz is not fully understood but is believed to be connected with the behavior of the $TE_{211}$ mode and $TE_{311}$ mode both of which have a response which looks like the response of two overcoupled modes rather than a single mode.

Figure 8:
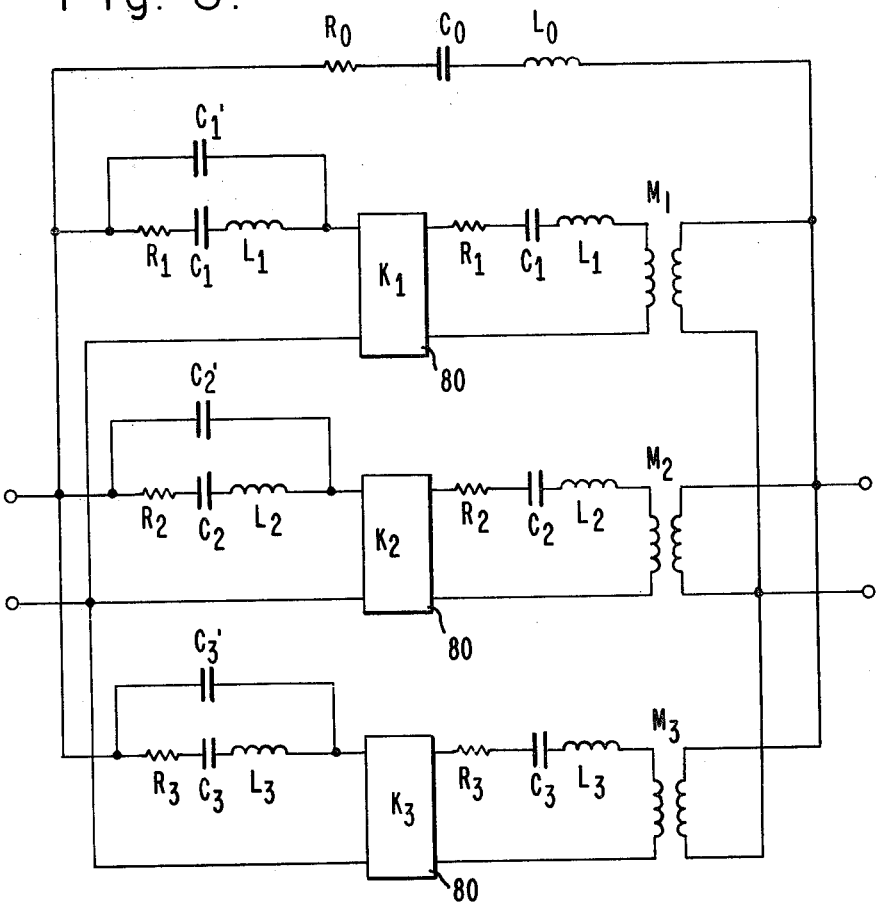
FIG. 8 is an analog model of a resonator.
Figure 9:
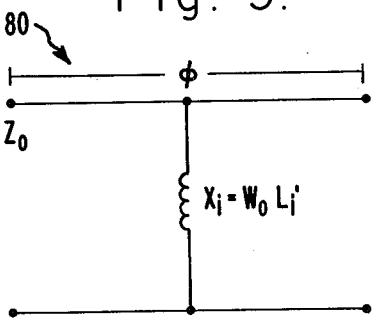
FIG. 9 is the impedance inverter circuit employed in the circuit of FIG. 8.

To facilitate the design of a resonator, i.e., the selection of the angle $\theta$, to meet the requirements encountered in the real world, a lumped constant analog circuit model (i.e. a simulation) of the resonator has been developed. This circuit model is schematically illustrated in FIG. 8. The circuit uses impedance inverters 80 to adjust the coupling between resonant circuits. The impedance inverter 80 is shown in FIG. 9.

Those circuit elements in FIG. 8 which have a subscript of 0 are used to model the $TE_{011}$ mode. Those elements which have a subscript of 1 are used to model the not fully suppressed $TE_{112}$ mode. Those elements which have a subscript of 2 model the $TE_{211}$ mode, and those elements with a subscript of 3 are used to model the $TE_{311}$ mode. The circuit representations of the $TE_{211}$, $TE_{311}$ and $TE_{112}$ modes are placed in parallel with the circuit representing the $TE_{011}$ mode. The $TE_{211}$ and $TE_{311}$ modes are each modeled as two series resonant circuits coupled by an impedance inverter 80, with one of the resonant circuits shunted by a small capacitor, i.e., $C'_2$ and $C'_3$. The use of the two series connected circuits permits the model to accurately model the actual resonator behavior which shows the $TE_{211}$ and $TE_{311}$ modes operating as if they were each two coupled resonators operating in an "over-coupled" mode as described earlier. A unity-coupled ideal transformer, $M_1$, $M_2$ or $M_3$, was placed in each circuit to effect the 180 degree phase shift, relative to the $TE_{011}$ mode, that occurs as the angular displacement $\theta$ between the input port 20 and output port 22 is varied. The relative coupling between the modes is controlled by the L to C ratios.

The values of the circuit elements of the impedance inverters 80 are determined according to the following formulae:

$$K_i = |Z_o \tan(\phi/2)|$$
$$\phi = -\tan^{-1}(2Xi/Z_o)$$
$$Xi/Z_o = \frac{Ki/Z_o}{1-(Ki/Z_o)^2} \text{ where } i = 1, 2, 3$$

$\phi$ represents the transmission length of the impedance inverter 80, i.e., the separation between the theoretical two cavities, operating in an overcoupled mode, used to model the response of the actual resonator.

Other models of impedance inverters 80 are readily available and there is nothing unique about the model used in the circuit of FIG. 8. The model actually used was chosen as a matter of convenience.

The transmission characteristics of the $TE_{011}$ mode resonator were calculated using the circuit model of FIGS. 8 and 9. In order to get the calculated response to show close correlation with the experimental data, the coupled resonator modeling the $TE_{112}$ mode was included. Similarly, the resistors $R_0$, $R_1$, $R_2$ and $R_3$ were added to the resonant circuits to model the unloaded Q. While the modeling of such phenomena is desirable for the sake of accuracy, it is not essential to the practice of the invention.

Figure 10:
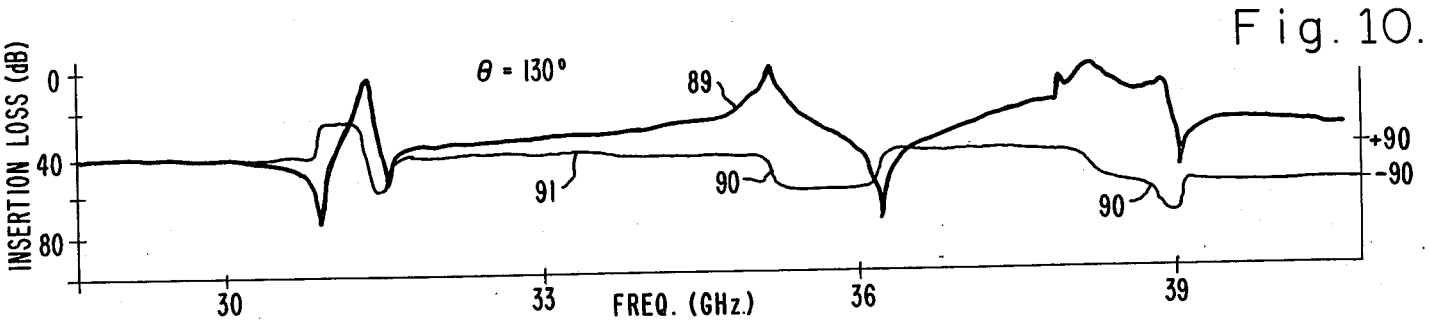
FIG. 10 is a graph of the modeled insertion loss of the resonator with an angular displacement of 130 degrees.
Figure 11:
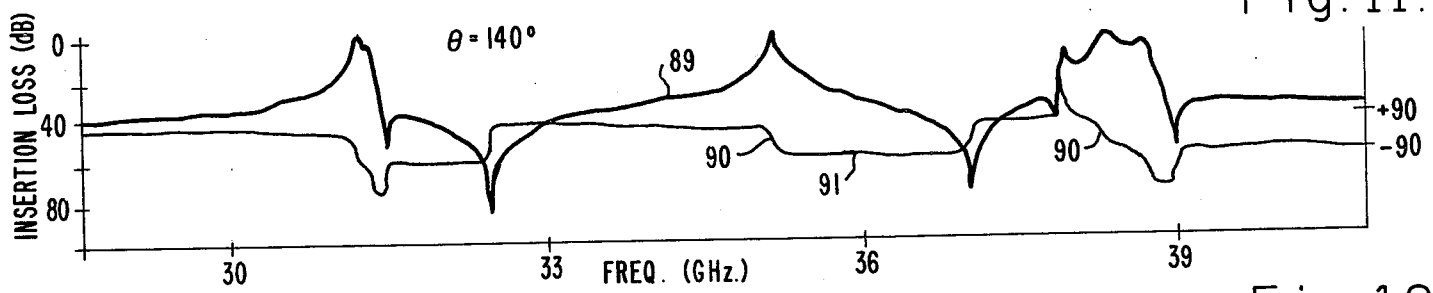
FIG. 11 is a graph of the modeled insertion loss of the resonator with an angular displacement of 140 degrees.
Figure 12:
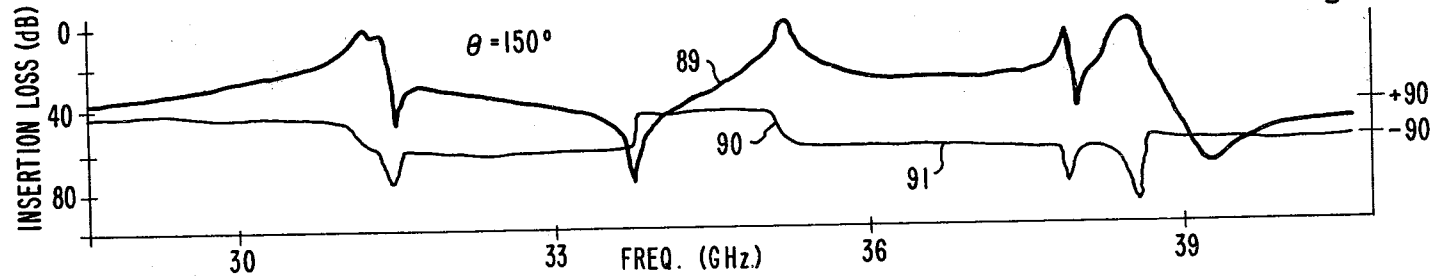
FIG. 12 is a graph of the modeled insertion loss with angular displacement set at 150 degrees.

Before the response of the modeled $TE_{011}$ resonator was calculated, rough values for each circuit element were determined from experimental and other data. The response of the modeled resonator was calculated using a Hewlett Packard 2100S computer and the Opnode circuit analysis program. While many other computers could as well be used, this model was chosen because of the excellent graphics capabilities available. After the initial calculations were performed, the circuit element values were modified to produce a calculated response that more closely agreed with the experimental data. The process was repeated to obtain an acceptably accurate match. When the calculated response closely matched the experimental data the circuit element values were recorded. This procedure was repeated for an angular displacement $\theta$ of 130, 140 and 150 degrees. The final values for each circuit element for each of the three values of $\theta$ are tabulated in Table 1. The corresponding calculated resonator transmission characteristics are plotted in FIGS. 10, 11 and 12 for $\theta$ equal to 130, 140 and 150 degrees respectively. The calculated amplitude characteristics shown in FIGS. 10, 11 and 12 as curves 89 correlate very well the the experimental data shown in FIGS. 5, 6 and 7 respectively. The calculated phase characteristics, shown as curves 91 in FIGS. 10, 11 and 12, clearly show the 180 degree phase reversals, indicated at points 90, which are necessary to provide the transmission nulls.

Figure 1B:
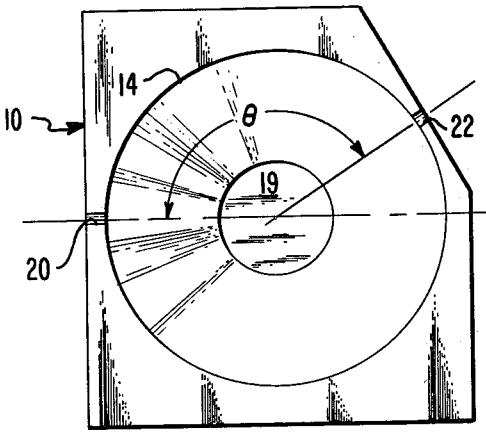
FIG. 1*b* is a transverse cross-sectional view of the cylindrical $TE_{011}$ mode resonator.

As an example of how the model shown in FIGS. 8 and 9 might be used to design a cavity with a null at a particular frequency, consider the following problem. Determine the angular displacement necessary to place a transmission null at a frequency of 33.5 GHz in a cavity such as shown in FIGS. 1*a* and 1*b*. From FIGS. 5, 6 and 7 we can see that the angular displacement must be between 140 degrees (FIG. 6) and 150 degrees (FIG. 7). From Table 1 we can see that, for the modeled 140 degree and 150 degree displacements, the circuit elements which show the most variation are those of the $TE_{112}$ and $TE_{211}$ modes. 33.5 GHz is approximately 73.3 percent of the frequency range between the null at 140 degrees of 32.4 GHz and the null at 150 degrees of 33.9 GHz. We can use linear interpolation to determine new values for those circuit components which exhibit change. Thus, a new value for $C_2$ could be calculated as $(1.1\times10^{-14})[1+(33.5-32.4)/(33.9-32.4)]$ or $1.906\times10^{-14}$. Similarly, new values could be calculated for each circuit element showing an appreciable change between its 140 degree value and its 150 degree value. The calculated new values would then be provided to the Hewlett Packard 2100S computer and the Opnode circuit analysis program. The computer would generate a new insertion loss curve. If the curve did not show a null at 33.5 GHz, another interpolation would be made to determine further circuit values. When the insertion loss curve showed a null at 33.5 GHz, the various circuit values would be recorded. By linear interpolation the angular displacement could be calculated. For example, if the final circuit values were moved from the values which produced good 140 degree curves 70 percent of the way toward the values which closely modeled the 150 degree curves, then the probable angular displacement would be 140 degrees +70% (150–140), or 147 degrees. To check the accuracy of this calculation, a cavity would be built having its input port separated from its output port by 147 degrees. Insertion loss measurements would be made on the actual cavity and theoretically a transmission null would be observed at 33.5 GHz. If the transmission null did not occur at 33.5 GHz, the newly acquired data obtained from the cavity with the 147 degree displacement could be used together with the data for 140 degrees and 150 degrees to perform a new linear interpolation to determine new values for the circuit elements. These values would then serve as a new starting point for the Opnode circuit analysis program. This iterative procedure could be repeated as many times as desired to more precisely determine the value of angular displacement to produce the null at 33.5 GHz. Of course the more sets of empirical data that are available, the fewer the number of iterations that would be required to get a reasonably accurate value for the angular displacement necessary to place a transmission null at a particular frequency.

A similar design approach could be used to adjust the selectivity of the filter.

Figure 14:
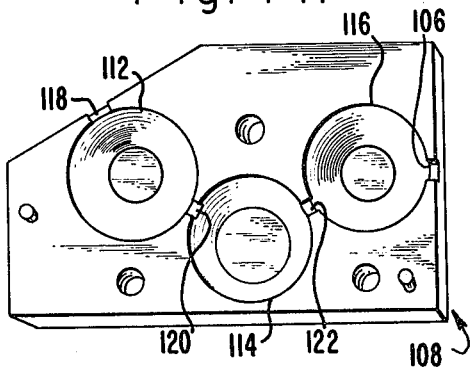
FIG. 14 is a cutaway view of the diplexer showing the three resonator filter configuration.
Figure 13:
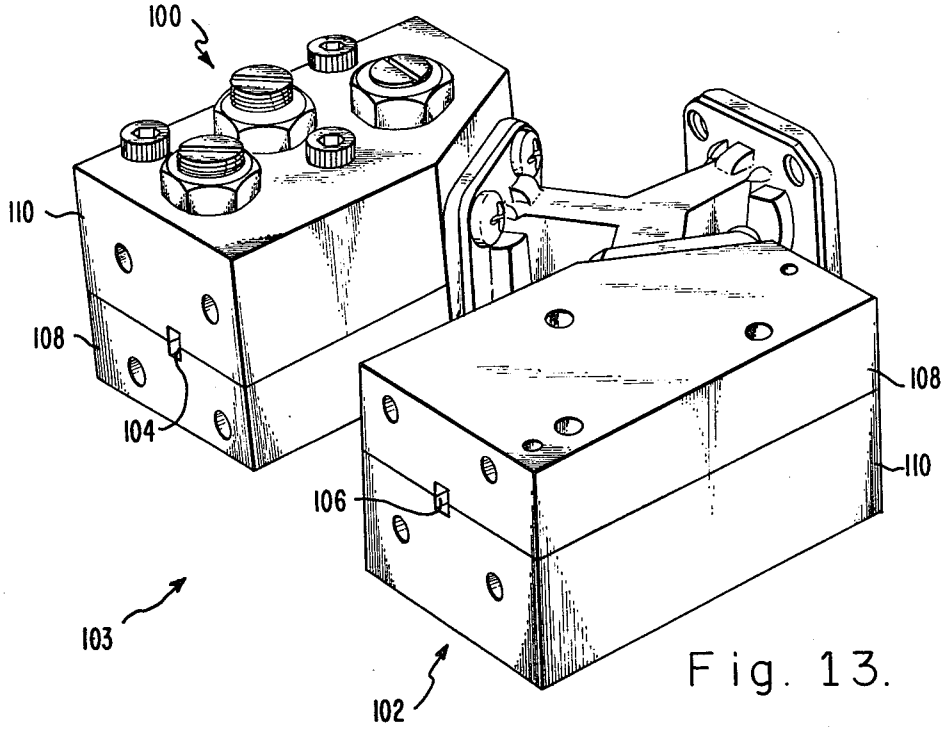
FIG. 13 shows a diplexer having multiple coupled resonators.

Not only may single resonators be designed utilizing the techniques taught herein, but multiple resonator filters such as those shown in FIGS. 13 and 14 may also be designed utilizing these techniques. FIG. 13 shows two $TE_{011}$ mode filters 100 and 102 each of which comprises three resonant cavities (resonators). The two filters are coupled to a Y-junction to form a diplexer 103. The output port of the two filters are shown at 104 and 106 respectively. Each filter 100 and 102 consists of two block portions, a thinner block portion 108 and a thicker block portion 110. FIG. 14 shows the interior of one of the thinner block portions 108 and the three resonators 112, 114 and 116. One half of the input port is shown at 118 and one half of the output port 106 is also shown.

The first resonator 112 has an input port 118 and an output port 120, separated by an angle $\theta_1$. The second resonator 114 uses the output port 120 of the first resonator 112, as its input port, and has its own output port 122 separated from its input port 120 by an angle $\theta_2$. The third resonator 116 uses the output port of resonator 114 as its input port, and port 106 is its output port. The input port 122 and output port 106 of the third resonator 116 are separated by an angle $\theta_3$.

Figure 15:
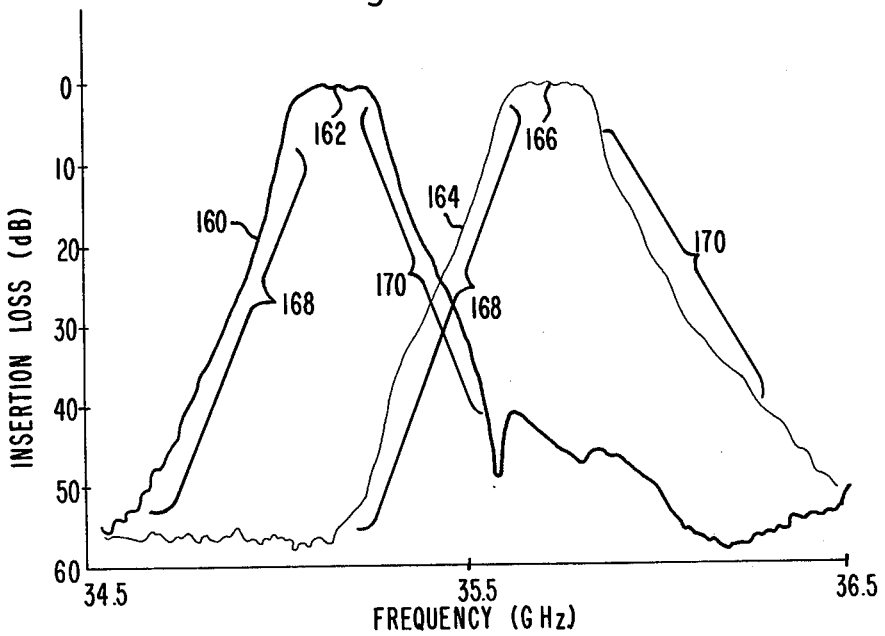
FIG. 15 is a graph of the insertion loss of the diplexer with resonators having angular displacements of 150 degrees, 120 degrees and 150 degrees.

FIG. 15 shows a plot of the insertion loss for the diplexer 103 of FIG. 13 having a pair of filters 100 and 102. The resonant cavities of filters 100 and 102 have different angular displacements between the input ports and output ports. Curve 160 having peak 162 is the plot for one of the two filters, e.g., 100, and curve 164 having peak 166 is the plot for the other filter, e.g., 102. Curves 164 and 160 were produced by filters 100 and 102 having three resonators with angular displacements between the input ports and output ports of 150 degrees, 120 degrees in the center resonator and 150 degrees. Note the improved steepness of the low frequency skirt 168 of curves 164 and 160 as compared to the steepness of the respective high frequency skirts 170 of curves 164 and 160.

There has thus been presented a design approach and method of design analysis for the cylindrical $TE_{011}$ filter which utilizes control of the interaction of the $TE_{011}$ mode with the $TE_{211}$ and $TE_{311}$ modes to improve filter selectivity and/or to place transmission nulls at a desired frequency in order to eliminate noise at that frequency. The circuit model accurately models the behavior of the circuit resonator and permits determination of the angular separation necessary to achieve the desired effect. The response of a given resonator can thus easily be tailored for a given application.

It should be noted that the shapes of the $TE_{011}$, $TE_{211}$ and $TE_{311}$ modes as shown in FIG. 2 are symmetric about the circular cavities. Accordingly, the design approach disclosed herein is not uniquely applicable to the angular range of 130 degrees to 150 degrees but is instead symmetric and repetitive about the cavity. More particularly, there are four cases of interest. First, the case where both the $TE_{211}$ and $TE_{311}$ modes are in phase with the $TE_{011}$ mode. Second, both $TE_{211}$ and $TE_{311}$ modes are out of phase with the $TE_{011}$ mode. Third, the $TE_{211}$ is in phase with $TE_{011}$, and $TE_{311}$ is out of phase with the $TE_{011}$. Fourth, the $TE_{211}$ mode is out of phase with the $TE_{011}$, and the $TE_{311}$ mode is in phase with the $TE_{011}$ mode. Inspection of FIG. 2 shows that all four cases occur within a displacement of between 45 degrees and 180 degrees between the input and output ports.

While the invention has been described with particular reference to a preferred method and analysis approach, as illustrated in the figures, the description and figures are for purposes of illustration and discussion only. Neither the description nor figures should be interpreted as limitations upon the nature of the invention or the scope of its applicability. The scope of the invention is intended to be limited only by the scope of the appended claims.

TABLE 1

| CIRCUIT ELEMENT | ANGULAR DISPLACEMENT 130° | 140° | 150° |
|---|---|---|---|
| $C_0$ | $3.4151 \times 10^{-15}$ | $3.4151 \times 10^{-15}$ | $3.415 \times 10^{-15}$ |
| $R_0$ | 0.1657 Ω | 0.1657 | 0.1657 |
| $L_0$ | $6.0 \times 10^{-9}$ | $6.0 \times 10^{-9}$ | $6.0 \times 10^{-9}$ |
| $C_1$ | $3.8048 \times 10^{-16}$ | $9.7866 \times 10^{-16}$ | $1.769 \times 10^{-15}$ |
| $R_1$ | 4.415 Ω | 1.716 Ω | 0.9510 Ω |
| $L_1$ | $4.635 \times 10^{-8}$ | $1.8 \times 10^{-8}$ | $1.0 \times 10^{-8}$ |
| $C_1'$ | $1.0 \times 10^{-12}$ | $1.0 \times 10^{-12}$ | $1.0 \times 10^{-12}$ |
| $L_1'$ | $2.2 \times 10^{-13}$ | $3.8 \times 10^{-13}$ | $4.4 \times 10^{-13}$ |
| $M_1$ | −1 | −1 | −1 |
| $C_2$ | $5.1785 \times 10^{-15}$ | $1.1 \times 10^{-14}$ | $2.0 \times 10^{-14}$ |
| $R_2$ | 0.3275 Ω | 0.1545 Ω | 0.08518 Ω |
| $L_2$ | $5.0 \times 10^{-9}$ | $2.3641 \times 10^{-9}$ | $1.3061 \times 10^{-9}$ |
| $C_2'$ | $1.5 \times 10^{-13}$ | $7.0 \times 10^{-13}$ | $8.4 \times 10^{-13}$ |
| $L_2'$ | $7.0 \times 10^{-13}$ | $7.0 \times 10^{-13}$ | $6.0 \times 10^{-13}$ |
| $M_2$ | −1 | 1 | 1 |
| $C_3$ | $1.4 \times 10^{-14}$ | $1.0 \times 10^{-14}$ | $1.226 \times 10^{-14}$ |
| $R_3$ | 0.1488 Ω | 0.2077 Ω | 0.1690 Ω |
| $L_3$ | $1.24 \times 10^{-9}$ | $1.7254 \times 10^{-9}$ | $1.4 \times 10^{-9}$ |
| $C_3'$ | $3.0 \times 10^{-13}$ | $2.7 \times 10^{-13}$ | $5.1 \times 10^{-13}$ |
| $L_3'$ | $1.6 \times 10^{31\ 13}$ | $2.6 \times 10^{-13}$ | $2.0 \times 10^{-12}$ |
| $M_3$ | 1 | 1 | −1 |

Capacitance in Farads and inductance in Henries; source and load impedances, 1 ohm.

What is claimed is:

1. A method for placing transmission nulls of a cylindrical cavity $TE_{011}$ mode resonator at a desired frequency comprising the step of:

placing the output port of said cavity resonator at a selected angular displacement with respect to the input port of said cavity resonator, said input and output ports lying in the same plane substantially perpendicular to the longitudinal axis of said cylindrical cavity resonator.

2. The method according to claim 1 wherein said angular displacement is selected to be within the range of 130 degrees to 150 degrees.

3. The method according to claim 1 wherein said angular displacement is 140 degrees.

4. A method for increasing the selectivity of a cylindrical cavity $TE_{011}$ mode resonator comprising the step of:

placing the output port of said resonator at a preselected angular displacement with respect to the input port so as to produce a transmission null of said resonator at a preselected frequency located selectively closer to the $TE_{011}$ resonance frequency, said input and output ports lying in the same plane substantially perpendicular to the longitudinal axis of said cylindrical cavity resonator.

5. The method according to claim 4 wherein said angular displacement is selected to be within the range of 130 degrees to 150 degrees.

6. A method for providing a cylindrical cavity $TE_{011}$ mode resonator with a transmission null at a desired and pre-selected frequency comprising the steps of:

(a) constructing a simulation of said resonator;

(b) analyzing the transmission characteristics of said simulation in order to determine the frequency of a transmission null;

(c) comparing the frequency of the transmission null with the desired and preselected frequency;

(d) adjusting the values of the elements of said simulation;

(e) repeating steps (b), (c) and (d) above as needed until the frequency of the transmission null of the simulation is acceptably close to the desired and preselected frequency; and (f) constructing a cylindrical cavity resonator having a circumferential angular separation between the input port and output port of said resonator equal to the angular separation indicated by the adjusted values of the elements of the simulation, said input and output ports lying in the same plane substantially perpendicular to the longitudinal axis of said resonator.

* * * * *